US006203076B1

(12) United States Patent
Wytcherley et al.

(10) Patent No.: US 6,203,076 B1
(45) Date of Patent: Mar. 20, 2001

(54) FOLD-DOWN HANDLE DEVICE

(75) Inventors: Roger Wytcherley, Suckley; Clive Morgan, Kidderminster, both of (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/431,407

(22) Filed: Nov. 1, 1999

Related U.S. Application Data

(63) Continuation-in-part of application No. 09/181,181, filed on Oct. 28, 1998, now abandoned.

(51) Int. Cl.[7] ..... E05C 3/04
(52) U.S. Cl. ..... 292/202; 292/336.3; 292/197
(58) Field of Search ..... 292/336.3, 27, 292/29, 46, 49, 52, 56, 98, 100, 102, 197, 202, 203, 257

(56) References Cited

U.S. PATENT DOCUMENTS

| | | | | |
|---|---|---|---|---|
| 397,555 | | 2/1889 | Keeler et al. | 292/100 |
| 1,521,112 | | 12/1924 | Lawrence | 292/202 X |
| 1,658,686 | | 2/1928 | Mory | 292/100 |
| 1,919,328 | | 7/1933 | Hansen | 292/202 X |
| 2,044,500 | | 6/1936 | Geske et al. | 292/254 |
| 2,599,511 | | 6/1952 | Dean | 292/100 |
| 2,673,756 | | 3/1954 | Axtell | 292/101 |
| 2,679,418 | | 5/1954 | Cisco | 292/256.6 |
| 2,709,832 | | 6/1955 | Claud-Mantle | 292/202 X |
| 2,720,772 | | 10/1955 | Atkinson | 292/202 X |
| 2,789,851 | | 4/1957 | Lickteig | 292/98 |
| 2,891,816 | * | 6/1959 | Meats | 298/38 |
| 3,896,698 | * | 7/1975 | Aylott | 85/7 |
| 4,443,032 | | 4/1984 | Bonassi | 292/202 |
| 5,620,213 | * | 4/1997 | Ellis | 292/210 |
| 5,669,638 | | 9/1997 | Anderson et al. | 292/111 |
| 5,785,362 | | 7/1998 | Nadherny | 292/98 |

* cited by examiner

*Primary Examiner*—Teri Pham Luu
(74) *Attorney, Agent, or Firm*—Paul & Paul

(57) ABSTRACT

A fold-down handle device for attachment to a first member, such as a panel, to provide a controlled pushing and pulling action on actuation for facilitating insertion and retraction of the first member to a second member, such as a cabinet, the handle device including a handle with a gripping portion, a cam member, a pawl member and a drive pin connecting the pawl member to the handle and extending through a slot provided in the cam member to regulate the movement of the pawl when the handle is lifted from a folded horizontal position to an upright vertical position.

18 Claims, 8 Drawing Sheets

FOLD-DOWN HANDLE DEVICE

CROSS-REFERENCE TO RELATED APPLICATIONS

This is a continuation-in-part of U.S. application Ser. No. 09/181,181, filed Oct. 28, 1998, and now abandoned the complete disclosure of which is herein incorporated by reference.

BACKGROUND OF THE INVENTION

1. Field of the Invention

The present invention relates to the field of latching devices, and, more particularly, to a handle actuated latch assembly having a foldable handle.

2. Brief Description of the Prior Art

Latch assemblies are relied on in a number of applications for securing items together, such as panel doors, containers, cabinets and compartments, as well as for securing components within a panel or cabinet. For example, a variety of fastening devices are often employed to secure electronic components in a panel or cabinet, or on a circuit board or other unit. The cabinet may have a lockable door to provide access to individual components. Some cabinets or units may include rack assemblies where electronic components are mounted on a rack for insertion and removal thereof. Generally, the components themselves which are installed in a rack or cabinet, may receive a plurality of wires or connectors which are connected thereto. Often, the electronic components must be removed for repair, upgrading or replacement. In some cases, rack components will preferably have a handle or grip for facilitating removal of the component from a cabinet or box or the like. In many cases the handle may be a permanently installed protruding pull member which can be gripped by a user to slide or insert a component into and out of the panel.

In some cases the handles or pulls can also be hinged so that they may fold to conserve space. The more space that is conserved enables a greater number of components to be installed within the cabinet, or, a smaller cabinet to be used.

There exists, however, applications in which hot-plugging of components is routinely performed. Power supplies are a type of component which are installed in a cabinet. For example, in certain applications, power supplies are "hot-swappable", requiring the system to continue to run while the power supplies are being changed. Insertion and retraction of a power supply in such applications generally requires that electrical connectors in the power supply be engaged or disengaged as the power supply is being inserted or retracted, respectively. Often the power supplies can have weights in excess of twenty pounds and therefore require a considerable force to release the power supply from a cabinet or frame, and also, at the same time, to disengage a connector. Furthermore, once the power supply is installed in position within a cabinet, panel or other unit, it is desirable to maintain it in its engaged position, so that it will not become inadvertently disengaged by an unexpected force, vibration, heat or the like.

While latching and fastening devices may be applied to retain components, such as, for example, a power supply, into a panel, it is desirable to use as little space as possible to leave room for other components and to minimize the size of the panel or unit volume. Camming action has been used in latching assemblies. For example, U.S. Pat. No. 5,669,638 "Fastening Device" issued on Sep. 23, 1997 to Glenn E. Anderson, et al, and assigned to Southco, Inc., the complete disclosure of which is herein incorporated by reference, discloses a fastening member with a cam mechanism used to withdraw a slide member.

A need exists for a folding down handle which can provide a controlled pushing and pulling action on actuation for retraction and insertion of a member to which the handle is installed.

SUMMARY OF THE INVENTION

A novel fold-down handle device for attachment to a member to provide a controlled pushing and pulling action on actuation to facilitate insertion and retraction, respectively, of a member to which the handle device is installed, the fold-down handle device further including a locking mechanism to lock the handle against actuation. A gripping portion is provided to actuate the foldable handle device and can also be used for transport of the member to which the foldable handle device is installed when the member is removed from a panel or being transported to a panel or unit for insertion therein.

It is an object of the present invention to provide a latching device wherein the folding of a handle operates to actuate the latching device.

It is a further object of the present invention to accomplish the actuation of a pawl member by pivotable movement of a handle to insert and retract a pawl member.

It is a further object of the present invention to provide a locking mechanism which can secure the handle from actuation to prevent unauthorized access.

Another object of the present invention is to provide a locking mechanism to lock the handle in its folded position.

Another object of the present invention is to provide a handle which can be lockable in a folded position and lifted to be maintained in a vertical position.

It is another object of the present invention to accomplish the above objects where the handle is provided as a generally u-shaped member.

It is another object of the present invention to accomplish the above objects where the handle is provided as a generally t-shaped member.

BRIEF DESCRIPTION OF THE DRAWING FIGURES

FIG. 1 is a parallel perspective view of a first alternate embodiment of a fold-down handle device according to the present invention, as viewed from the bottom.

FIG. 1*a* is an enlarged partial side view of the fold-down handle device of FIG. 1, showing the pawl positions relative to the cam member.

DETAILED DESCRIPTION OF THE PREFERRED EMBODIMENTS

Figure 1:
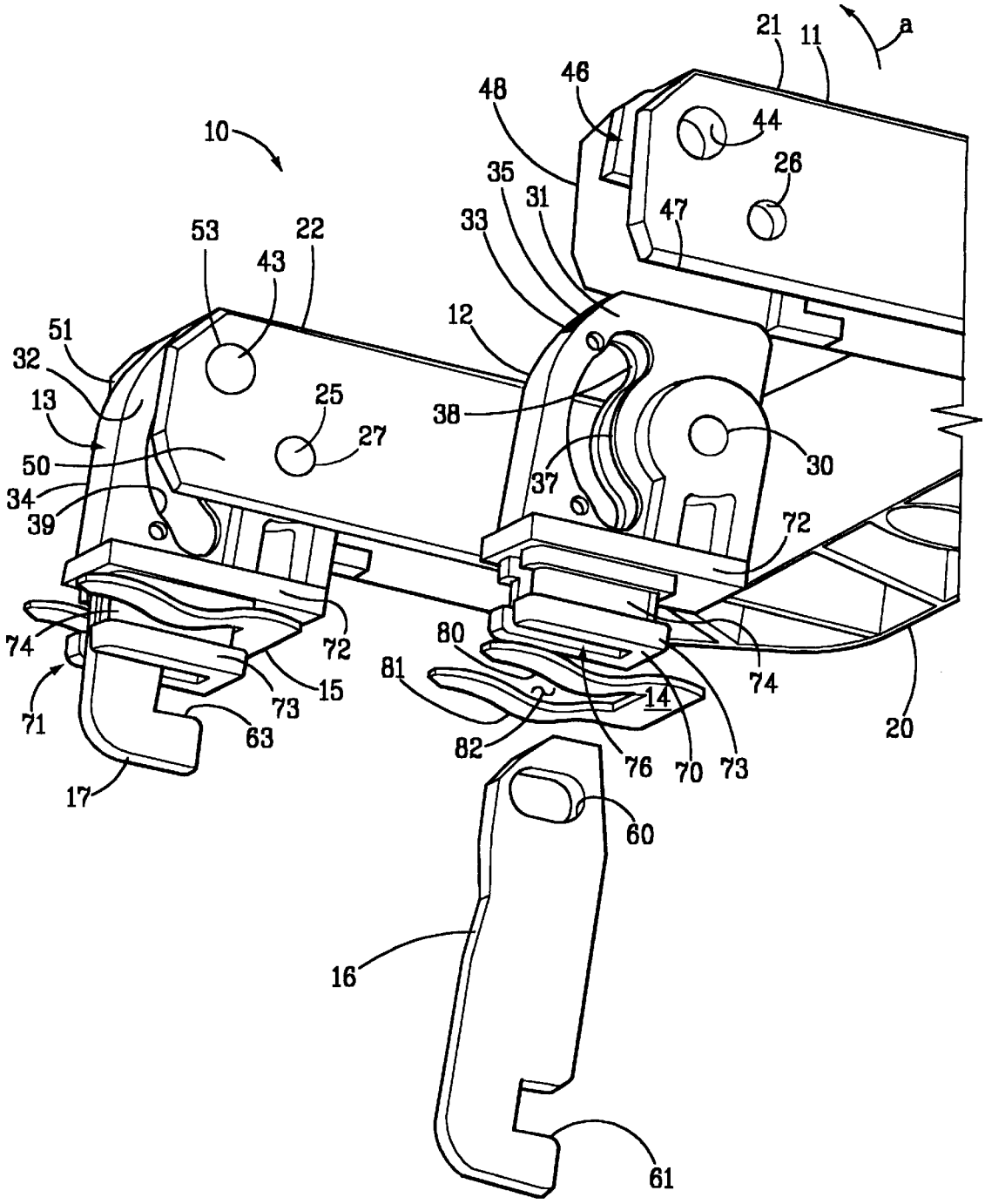

Referring to FIG. 1, a fold-down handle device 10 is shown according to the present invention, having actuating means comprising a handle 11. The handle device 10 further comprises a pair of cam members 12 and 13, retaining means for retaining the handle device 10 onto a panel or other member, the retaining means shown comprising a pair of retaining members 14, 15, and pawl means shown comprising a pair of pawl members 16, 17.

Figure 5:
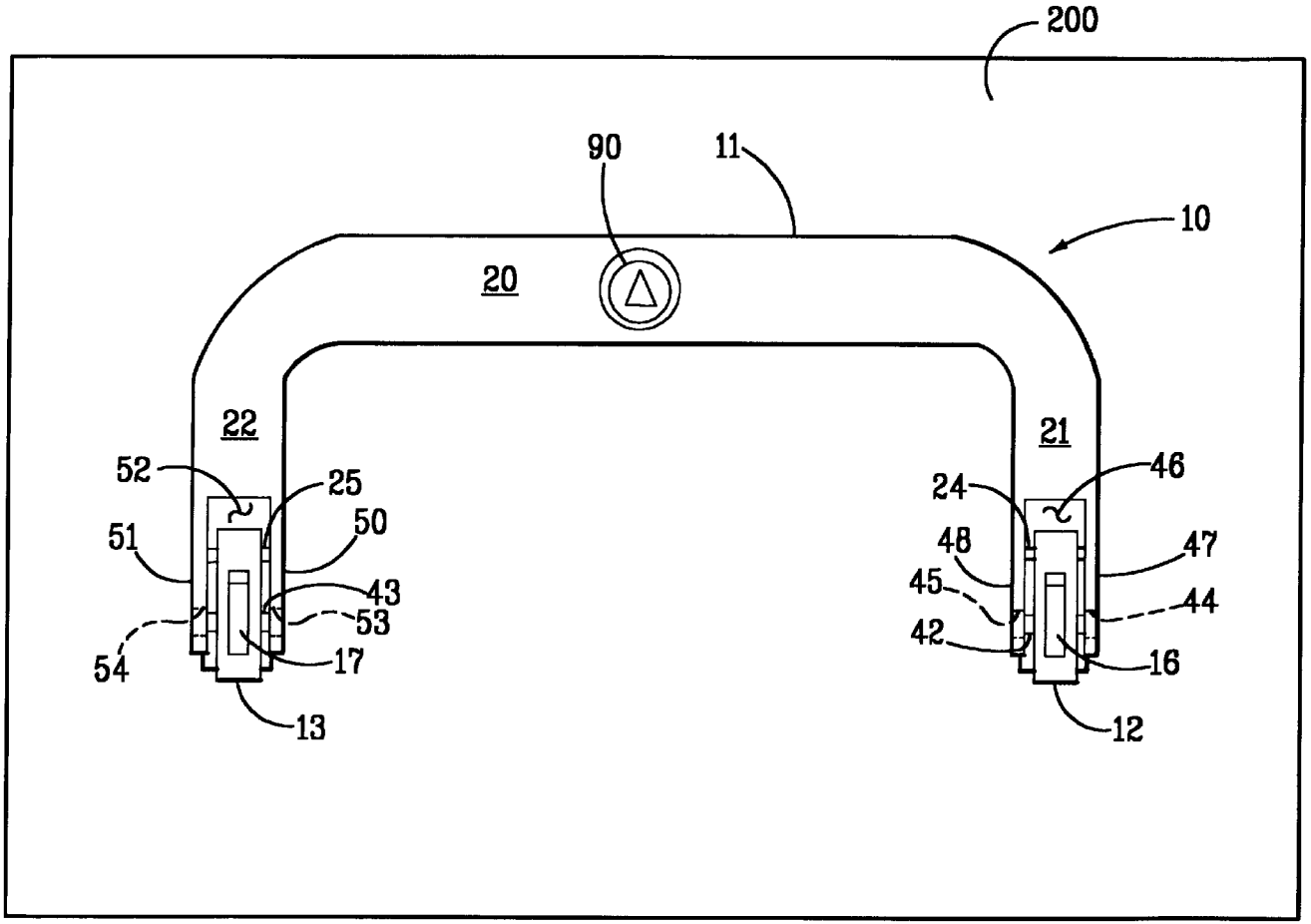
FIG. 5 is a top plan view of the handle device of FIG. 1 shown installed on a panel.

The handle 11, as best shown in FIGS. 1 and 5, includes a gripping portion 20 for facilitating gripping by a user, and a pair of legs 21, 22 extending therefrom. Each leg 21, 22 is connected to the gripping portion 20 at one end thereof and at the other end thereof includes means for connecting the handle 11 to the cam members 12, 13.

Connecting means is shown preferably comprising a fastening member, such as for example, the pin members 24, 25 which are provided to extend through respective pin apertures 26, 27 disposed in each of the handle legs 21, 22. The cam members 12, 13 are provided with apertures 30, 30', respectively, which align with the handle pin apertures 26, 27 of the first leg 21 and second leg 22, respectively, for connection of the pin members 24, 25 to each respective cam 12, 13, as shown in FIG. 5. The handle 11 is pivotally maintained in relation to the cam members 12, 13. While the pin members 24, 25 are shown, it is further understood that any suitable fastening member which can pivotally connect the handle 11 to the cam members 12, 13 can be employed.

The cam members 12, 13 are shown provided as a pair, each respectively having a first wall portion 31, 32 and a second wall portion 33, 34 defining a guide slot 35, 36, therein. As shown in relation to the first cam member 12, cam grooves 37, 38, disposed respectively, in the first wall portion 31 and second wall portion 33 of the cam member 12 are provided. The second cam member 13, likewise has grooves 39 and 40 disposed, respectively, in the first wall portion 32 and second wall portion 34.

Figure 2:
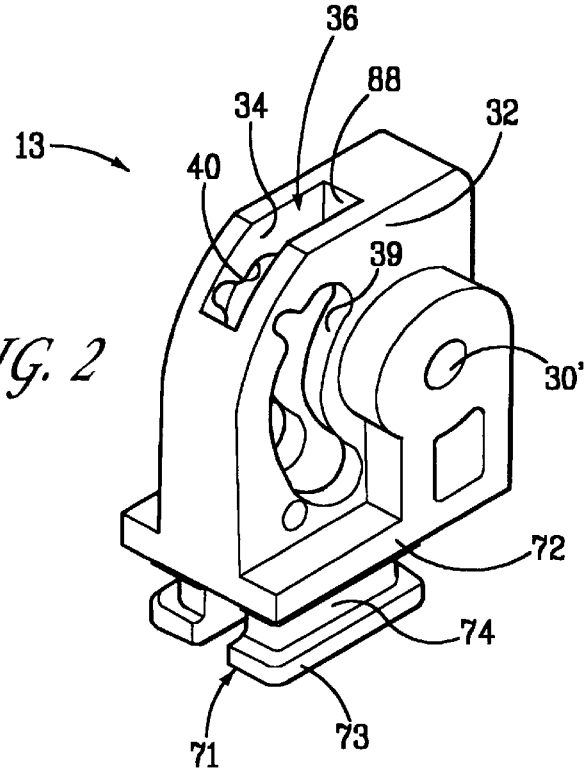
FIG. 2 is a parallel perspective view of a cam member of the handle device shown in FIG. 1.

The first cam member 12 is shown in a separate view in FIG. 2. The cam grooves 37, 38 are aligned with one another to receive a drive pin 42 which is provided to extend through the drive pin aperture 44 provided on the first leg portion 21 of the handle 11.

As shown in FIG. 5, the first leg portion 21 includes a slot 46 disposed therein and defined on each side by a leg wall portion 47 and 48. A drive pin aperture 44, 45 is provided in each wall portion 47, 48, respectively, of the first leg member 21. The second leg portion 22 of the handle 11 is likewise provided comprising leg wall portions 50 and 51 defining a space 52 therebetween and having a drive pin aperture 53, 54 disposed, respectively, in each leg wall portion 50, 51. The drive pin 43 is shown installed within the drive pin apertures 53, 54 of the second leg portion 22.

Figure 3:
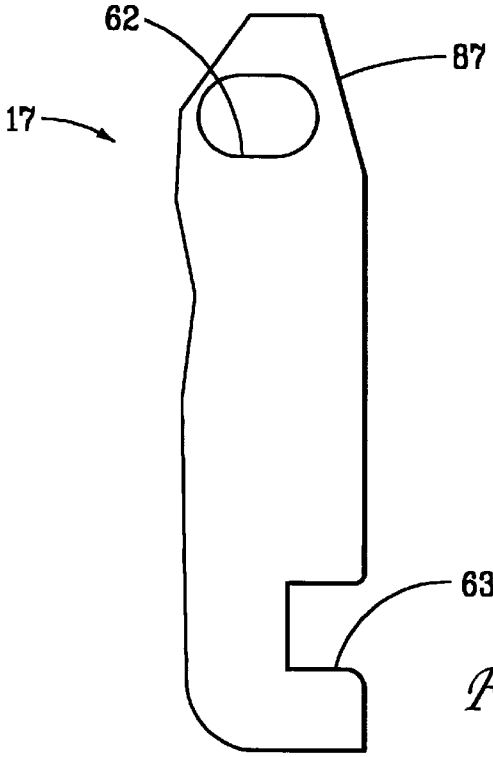
FIG. 3 is a front elevation view of a pawl member of the handle device shown in FIG. 1.

As shown in FIG. 3, pawl means is provided comprising a pawl member 16 having a retaining slot 60 disposed therein and a notched engaging portion 61 provided at one end thereof. The pawl member 17 shown in FIG. 1, preferably, will be provided in an identical manner, having a retaining slot 62 and an engaging portion 63. Referring to FIG. 1, the pawl member 17 is shown installed within the handle device 10. The drive pin 43 retains the pawl member 17 on the handle device 10 by extending through the retaining slot 62 of the pawl member 17. Pawl members 16, 17 are each disposed for movement within the guide slots 35, 36, respectively, of the first and second cam members 12, 13.

The fastening pins 24, 25 are provided to pivotally connect the legs 21, 22 of the handle 11 with the cam members 12, 13, respectively. The fastening pins 24, 25 fix the handle pivot axes at those locations. The cam pins 42, 43, each of which extends respectively through a pawl member retaining slot 60, 62, are movable, respectively, within the cam slots 37, 38 of the first cam member 12, and within the cam slots 39, 40 of the second cam member 13, when the handle 11 is lifted for actuation and rotated about its fixed pivot axis 24, 25. As shown in FIGS. 1 and 5, the handle 11 is positioned approximately at a right angle with respect to the cam members 12, 13. When the handle 11 is lifted to a vertical position relative to the cam members 12, 13, as indicated in the direction of arrow "a", the pawl members 16, 17 are lowered from the cam members 12, 13. Preferably, the handle device 10 is mounted to a member such that when the handle 11 is actuated by lifting to thereby lower the pawl members 16, 17, the lowering of the pawl member 16, 17 disengages the component to which the device 10 is mounted. For example, the component can comprise a power supply which has plugs or connectors, which upon actuation of the handle 11 can themselves become disengaged to release the member for removal from the unit or device to which it previously had been attached.

Figure 4:
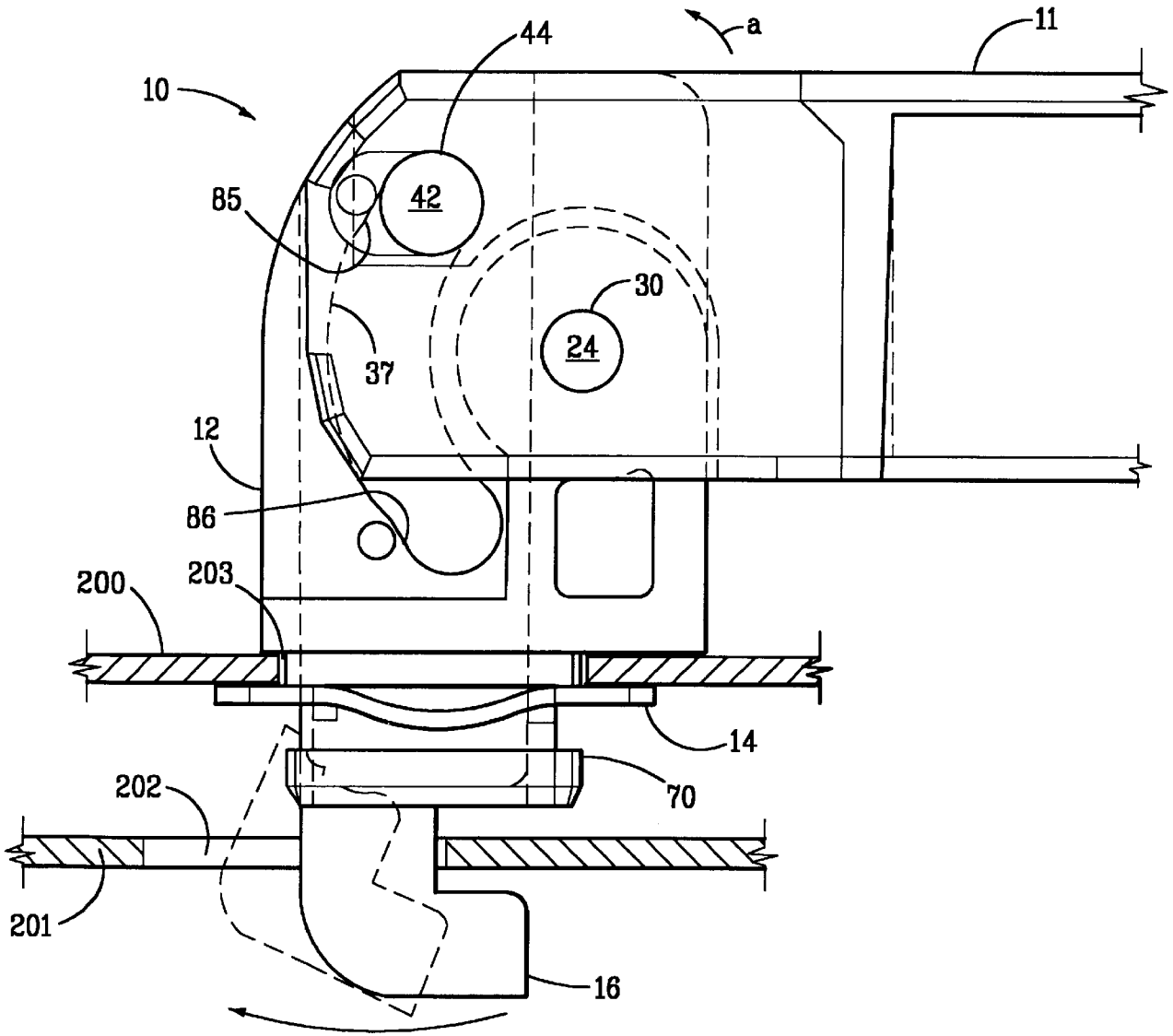
FIG. 4 is a side elevation view of the handle device of FIG. 1 shown installed on a first panel and connecting with a second panel.

Retaining means is provided to secure the device 10 to a component member, such as, for example, a panel or cabinet. The retaining means is shown in FIGS. 1 and 4 preferably comprising a pair of feet 70, 71, provided, respectively, on the first cam member 12 and the second cam member 13. The feet 70, 71 are identical so only one foot 70 will be described (that one 70 in connection with the first cam member 12). As shown best in FIGS. 1, 2 and 6, the foot 70 includes an upper flange portion 72 a lower flange portion 73 and a retaining groove 74 disposed between the upper flange portion 72 and the lower flange portion 73. The foot 70 also includes a slot 76 disposed therein for accommodating the pawl member 16 as it is raised and lowered by the handle 11. A retaining member 14 is also provided. The retaining member 14 can have a pair of legs 80, 81 which are separated to define a slot 82 therebetween. Preferably, the retaining member 14 comprises a spring member. The panel or component to which the handle device 10 is to be installed is prepared by providing apertures through which the feet 70, 71 can pass. The feet 70, 71 are then secured to the panel by the insertion of the retaining members 14, 15 which are installed respectively on each foot 70, 71. The legs 80, 81 of the retaining member 14 are provided to be received in the groove 74 defined between the upper flange portion 72 and the lower flange portion 73 of the foot 70.

Figure 1A:
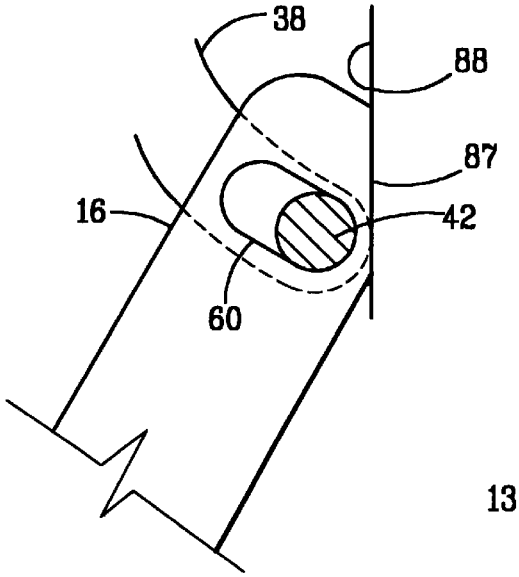

As shown in FIG. 1*a*, the drive pin 43 connects the pawl 16 to the handle 11. The drive pin 43 is shown positioned in the extreme end of the retaining slot 60. The pawl 16 has an engaging edge portion 87 which is shown engaging the limiting wall 88 (FIG. 2) of the first cam member 12. This extreme position of the pawl 16 relative to the drive pin 43 (as shown in FIG. 1*a*) causes the pawl 16 to move sideways relative to the cam member 12. This feature is preferably provided to ensure that the pawl notch 61 is fully disengaged from a keeper or other member or surface to which it is attached (see FIG. 4). For example, if the pawl 16 is associated with plugs or connectors, the release feature can facilitate withdrawal of such plugs or connectors.

Positioning means is provided to hold the handle 11 in its extreme positions—fully opened (vertical) or fully closed (horizontal). For example, the handle 11 is maintained by the positioning means in a generally vertical position relative to the member to which the device 10 is attached in order to facilitate gripping of the handle 11. For facilitating locking, the handle 11 is maintained in its horizontal or folded position. The positioning means is shown comprising an upper indent 85 provided on the wall of the cam slot 37 (there being an identical indent provided on the wall of the cam slot 38). The upper indent 85 functions to maintain the handle 11 in a gripping position (FIG. 6) and to permit full disengagement of the pawl 16. The positioning means further comprises a lower indent 86 provided on the wall of the cam slot 37 (with an identical lower indent provided on the wall of slot 38). The lower indent 86 operates to maintain the handle 11 in a locking position.

The positioning means releasably maintains the handle 11 which can be selectively moved into and out of the positioning location.

Figure 6:
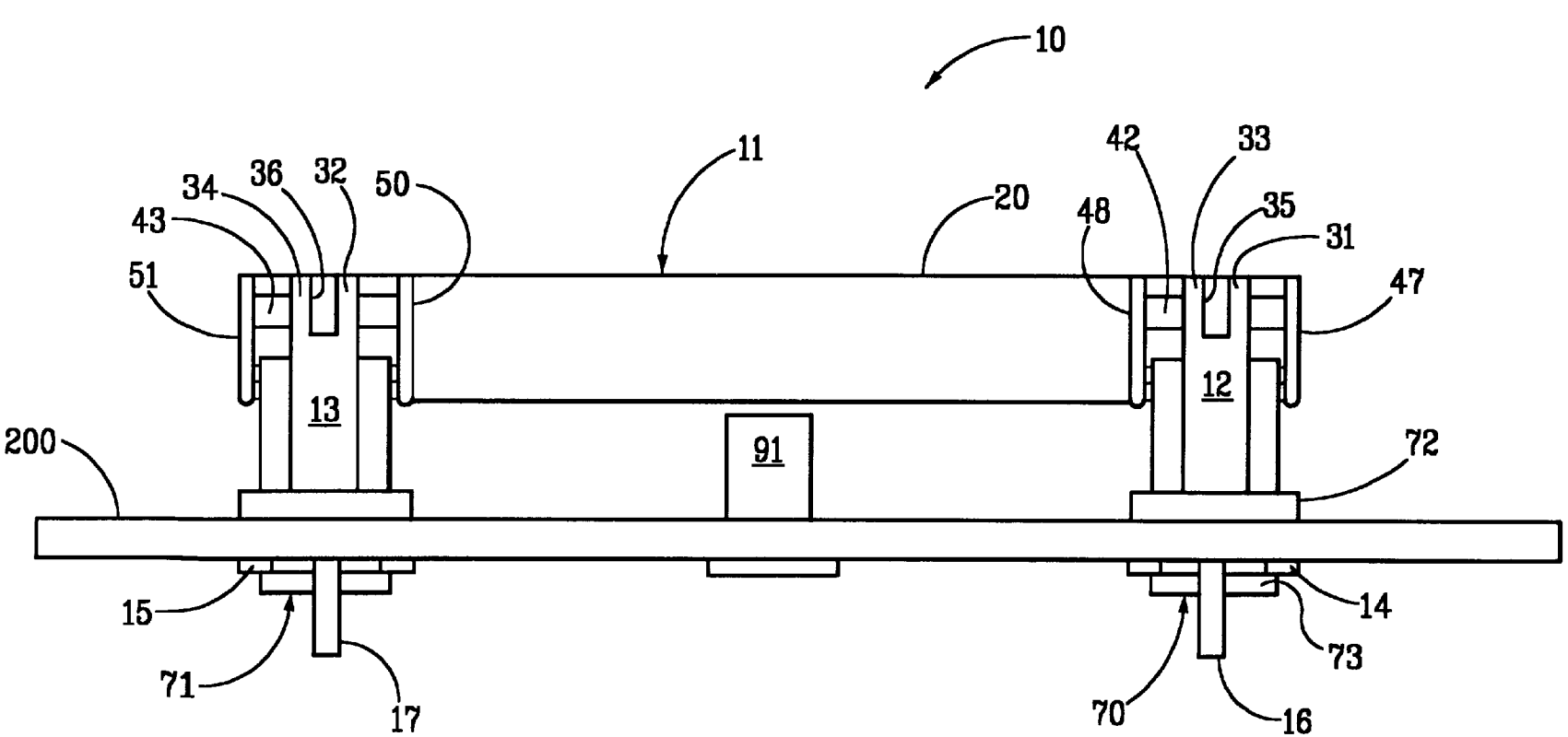
FIG. 6 is a rear elevation view of the handle device of FIG. 5.

The handle device 10 can further comprise locking means for locking the handle 11 in a position so that it cannot be actuated. The locking means is shown in FIG. 5 comprising a fastening member 90 which is provided on the gripping portion 20 of the handle 11. The fastening member 90 also includes a retaining part 91 which, as shown in FIG. 6, is preferably installed on a panel or other member to which the device 10 is mounted. The retaining part 91 is provided in the area below the position of the fastening member 90 when the handle 11 is in its folded-over position (FIGS. 1 and 4). The fastening member 90 for example, can include a quarter-turn fastener, such as a screw member, disposed within the gripping portion 20 of the handle 11. The retaining part 91, for example, can comprise a standard receptacle member, such as a quarter-turn receptacle, provided on the mounting panel 200 to receive the quarter-turn fastener. The locking means may further comprise spring means which will operate to provide a bias toward lifting of the handle 11 when the lock or fastener 90 is unlatched from the receptacle. It is further conceivable that a slam-action type locking arrangement can be achieved, as well as screw or tool shaped configured fasteners. In addition, a key lock or other suitable locking or securing device can also be employed.

Referring to FIG. 4, the handle device 10 is shown installed in a first panel 200 and securing a second panel 201. The pawl member 16 is shown extending into a rectangular slot 202 provided in the second panel 201. In the broken line view, the pawl 16 is shown in its released position which it occupies when the handle 11 is raised in the direction of arrow "a" from its horizontal or fastened position to its vertical released position. The handle device 10 is mounted on a first panel 200 with the foot 70 of the cam member 12 shown inserted in a cut-out portion 203 provided in the first panel 200. The retaining member 14 engages the foot 70 of the first cam member 12 and secures the first cam member 12 to the first panel 200. Although one side is shown, it will be understood that the opposite handle side will be mounted in the first panel 200 and engage the second panel 201 in the same manner.

While a handle 11 is shown having legs 20, 21 associated with a pair of cam members 12, 13, an alternate embodiment can be provided for example, where the handle has a single leg configuration and is used in association with a single cam member. For example, the single leg handle may be provided in a T-shaped configuration.

Figure 7:
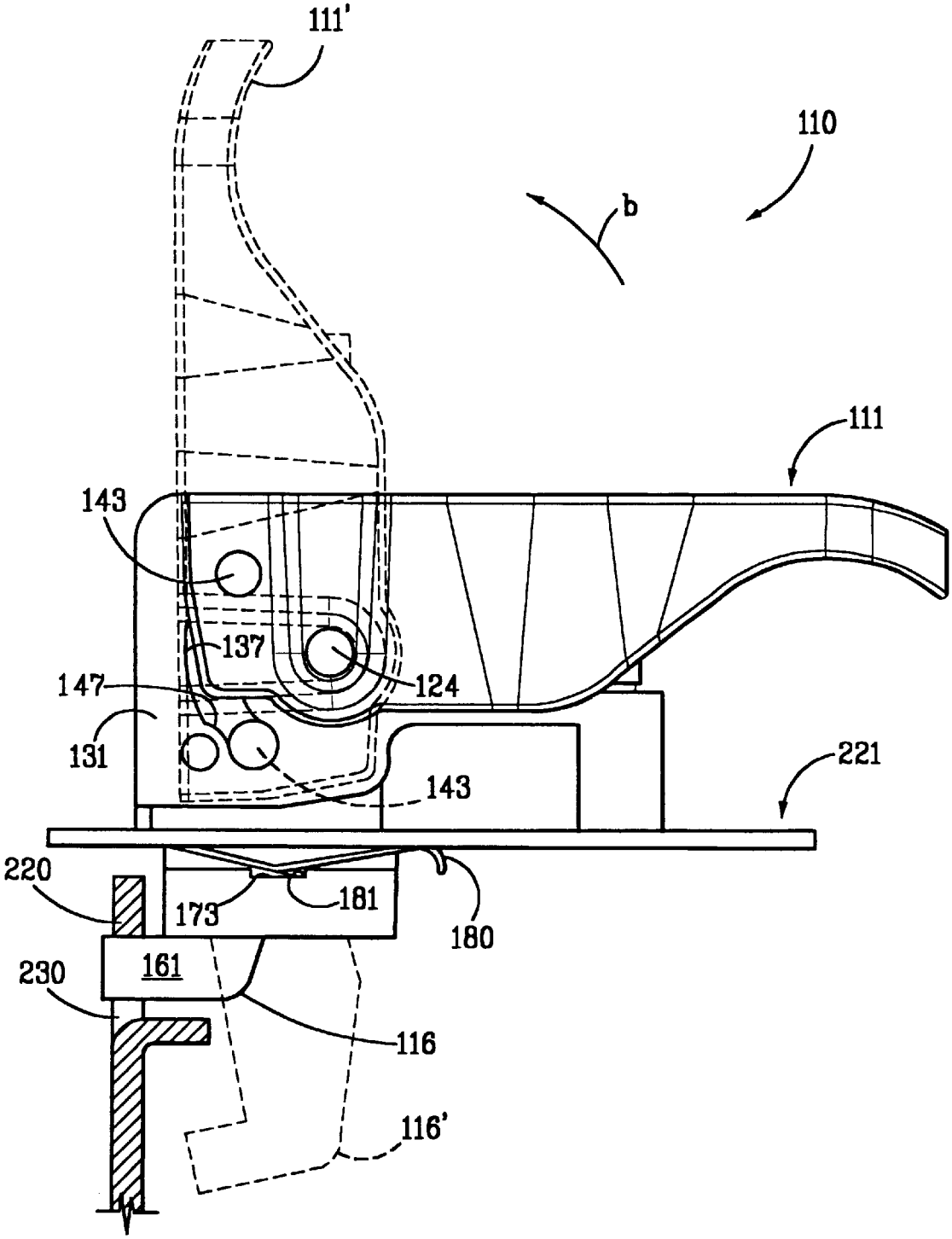
FIG. 7 is a right side elevation view of a second alternate embodiment of a fold-down handle device according to the present invention, shown installed on a panel and securing the panel to a frame.

Reference now being made to FIG. 7 where a second alternate embodiment of a fold-down handle device 110 is shown. The second alternate embodiment 110 is similar to the first embodiment 10, but instead the actuation means comprises a lever actuating member or handle 111, which controls the operation of the pawl 116. The pawl member 116 can be configured to be similar to the pawl member 16 described above in connection with the first alternate embodiment shown in FIGS. 1–6. The pawl member 116 has a retaining slot 160 for retaining the pawl 116 on the assembly 110, and an engaging end 161 shown comprising a foot 161. It will be understood that the engaging end can be configured to operate with a variety of keeper configurations, consistent with the principles of the present invention. A notch 162 provided in the back of the pawl 116 facilitates alignment of the pawl 116 to a predetermined position where the pawl 116 is completely released from any engagement with the keeper or member. Preferably, the notch enables the pawl 116 to kick out away from the keeper (not shown).

The handle 111 is shown, preferably, provided having a lever configuration with a lifting portion 119 at the free end thereof for facilitating lifting of the handle 111 to release the pawl 116 from engagement with a keeper or other securing member. The lifting portion 119 preferably comprises a curved configuration for accommodating a user's fingers or thumb when lifting the handle 111.

Figure 8:
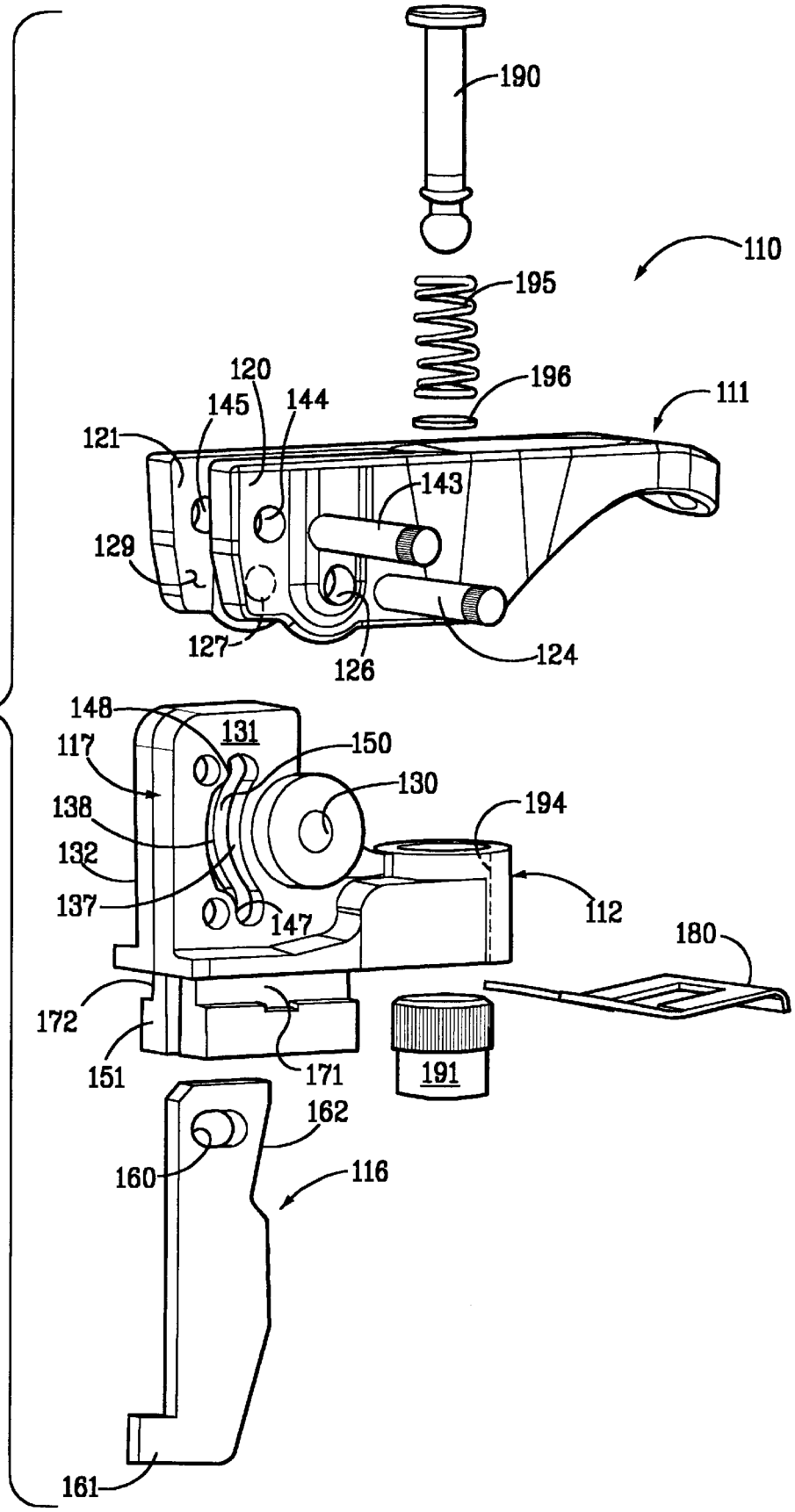
FIG. 8 is an exploded assembly view showing the components of the handle device of FIG. 7.

Referring now to the assembly view of FIG. 8, the handle 111 is shown having a pair of legs 120, 121 extending therefrom and being spaced apart from each other to define a space 129 therebetween. Connecting means is provided to connect the handle 111 with the cam means 117 of the housing 112. The connecting means, for example, can comprise a fastening member, such as the mounting pin member 124 which is provided to extend through respective pin apertures 126, 127 disposed in each handle leg 120, 121, respectively. The housing 112 is provided with a bore 130 in which the mounting pin 124 is installed to pivotally mount the handle 111 to the housing 112. While a knurl pin 124 is shown, it will be understood that any suitable connecting member which can pivotally mount the handle 111 to the housing 112, such as rivets, bolts, and the like, can be used. The handle 111 is provided to fold down, from the broken line position in FIG. 7 to the solid line position.

The cam means 117 has a pawl receiving slot 150 disposed therein for accommodating the pawl 116 therein. As shown in FIG. 7, the pawl 116 is partially disposed in the pawl receiving slot 150 of the cam means 117, and extends outwardly from the mounting portion 151 of the housing 112. Referring again to FIG. 8, the pawl receiving slot 150 is defined by a first housing wall portion 131, and a second housing wall portion 132. A cam groove 137, 138, is disposed respectively, in each of the first housing wall portion 131 and second housing wall portion 132. The cam grooves 137, 138 oppose each other and are aligned with each other to receive a drive pin 143 which extends therethrough.

The drive pin 143 is provided to extend through the drive pin apertures 144, 145 disposed in the handle legs 120, 121, respectively. The drive pin 143 also extends through the retaining slot 160 of the pawl 116 and retains the pawl 116 on the device 110. The handle 111 pivots about the axis of the mounting pin 124, and the cam pin 143 which is fixed to the handle legs 120, 121 moves through the cam grooves 137, 138.

As shown in FIG. 7, the handle 111 is positioned approximately at a right angle with respect to the housing 112. When the handle 111 is lifted to its vertical position (shown in dashed lines as 111') relative to the housing, as indicated in the direction of arrow "b", the pawl 116 is lowered from the housing 112. Preferably, the foldable handle device 110 is mounted to a member such that when the handle 111 is actuated by lifting to thereby lower the pawl 116, the pawl becomes disengaged from the mounting member 220. The mounting member can comprise any suitable member such as a rack, frame, box, and the like. Preferably, as shown in FIG. 7, the fold-down handle device 110 can be mounted to a panel, such as for example, the front panel 221 of a component, such as a power supply or other device. For example, the component can comprise a power supply which has plugs or connectors, which upon actuation of the handle 111 can themselves become disengaged to release the component member for removal from the unit or device to which it previously had been attached.

The foldable handle device 110 is shown mounted on a panel 221 in FIG. 7. Retaining means is provided to secure the fold-down handle device 110 to the panel or component member. The retaining means shown in FIGS. 1 and 4 (above) in connection with the first foldable latch device embodiment 10 can be used to mount the housing 112 to the panel 221. The retaining means is shown comprising a foot 170 disposed on the housing 112. The foot 170 is shown configured with grooves 171, 172 disposed on each side thereof. A locking notch 173 is also provided on the groove 171, there being an identical locking notch (not shown) provided similarly on the groove 172.

Figure 9:
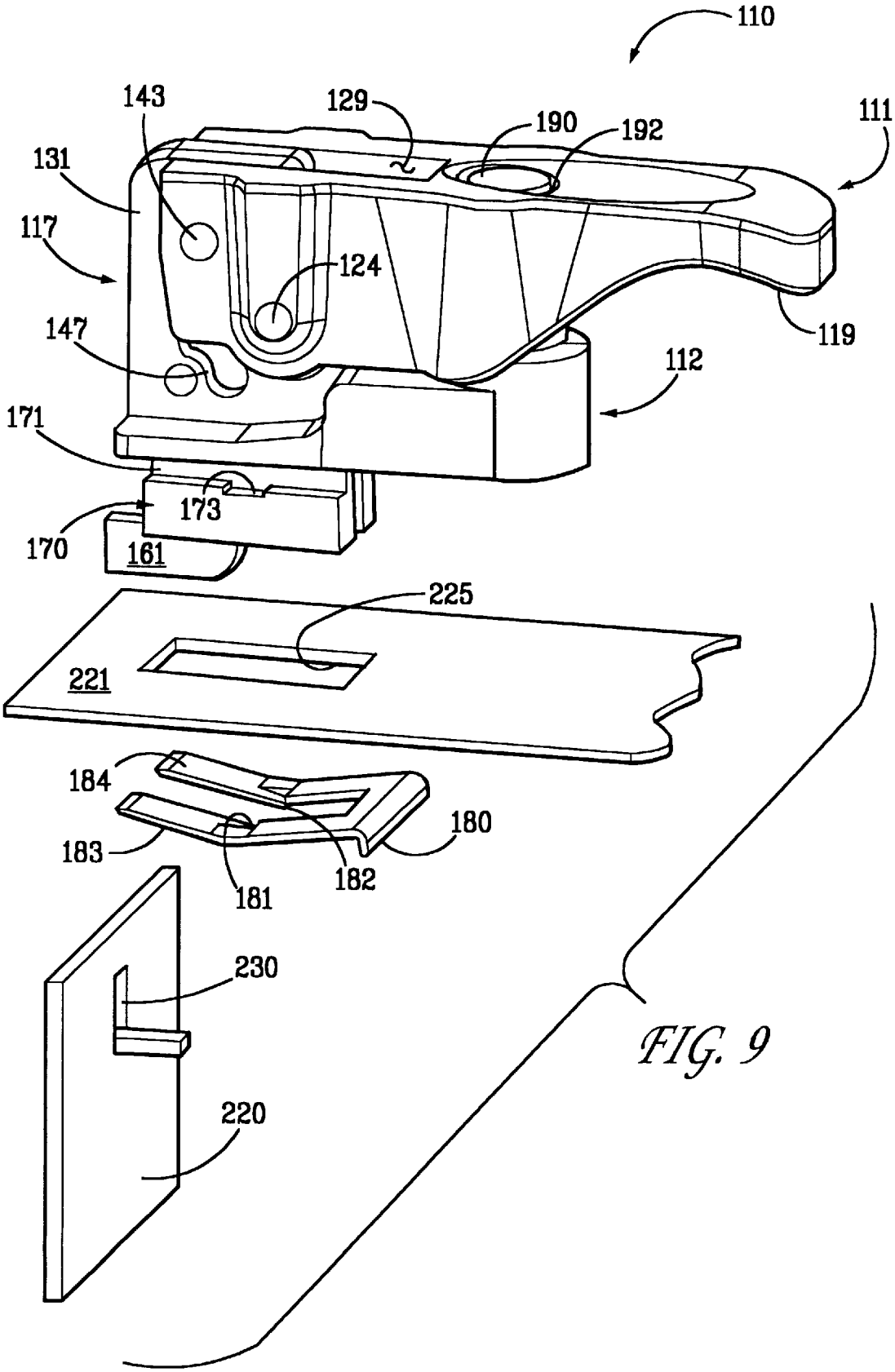
FIG. 9 is a parallel perspective view of the handle device shown in FIGS. 7 and 8.

A retaining member or clip 180 is also provided to clamp the handle device 110 to the panel 221. As shown in FIG. 9, the retaining member 180 has a pair of legs 183, 184 with a barb 181, 182 disposed respectively on each leg 183, 184. The barbs 181, 182 are provided to lock with the locking notches, such as the locking notch 172 which is shown in FIG. 7 with a barb 181 held therein. The barbs 181, 182 facilitate retention of the handle device 110 on the mounting member or surface, such as the front panel 221 shown in FIGS. 7 and 9. The retaining member or clip 180 preferably comprises a spring member, such as a spring steel, plastic or other flexible material suitable to retain the housing 112 on a panel. As shown in FIGS. 7 and 9, the foot 170 of the housing 112 extends through an aperture 225 provided in the front panel 221. The retaining member 180 clips onto the foot 170 to secure the foldable handle device 110 to the panel 221.

The pawl 116 is shown in FIG. 8 in a secured position, with the engaging foot 161 of the pawl 116 positioned in an aperture 230 of a frame panel 220. When the handle 111 is lifted from the solid line position to the broken line position, the pawl 116 releases from the frame panel 220 and moves from its solid line position to a position shown by the broken line pawl 116'.

The component to which the handle device 110 is to be installed, such as, for example, the front panel 221 is prepared by providing an aperture 225 through which the housing root 170 can pass. The foot 170 is then secured to the panel 221 by installing the retaining member 180 on the foot 170.

Referring again to FIG. 8, the notch 162 provided on the back of the pawl 116 regulates the position of the pawl 116 relative to the housing 112 when the handle 111 is raised. The notch 162 can provide additional clearance within the pawl receiving slot 150 to enable the pawl 116 to retract to its broken line position 116' shown in FIG. 7.

Detent means is provided for positioning the handle 111 in the closed and raised positions, respectively. For example, an indented portion 147, 148 is shown at each extreme end of the cam groove 137, there being a corresponding indented portion on each extreme end of the opposing cam slot 138 (not shown). The indented portions 147, 148 can be provided to facilitate positioning the cam pin 143 to maintain it in the cam grooves 137, 138 at a location which secures the pawl 116 with the frame 220 or retracts the pawl 116 from the frame 220. The extreme position of the handle 111' shown with the cam pin 143 lowered in the cam groove 137 beyond the indented portion 147 corresponds to the pawl 116' position where it is released from the frame 220. When the handle 111 is 25 raised to this position, the pawl 116 moves sideways relative to the housing 112 to the broken line position 116'. This feature is preferably provided to ensure that the pawl notch 161 is fully disengaged from a keeper or other member or surface to which it is attached. For example, if the pawl 116 is associated with plugs or connectors, the release feature can facilitate withdrawal of such plugs or connectors.

The detent means, described above, also serves as positioning means for holding the handle 111 in its extreme positions—fully opened (vertical) or fully closed (horizontal). The positioning means releasably maintains the handle 11 which can be selectively moved into and out of the positioning location.

Preferably, locking means is provided to secure the handle 111 against unauthorized opening. The locking means is provided to lock the handle 111 with the housing 112 so that pawl 116 can not be actuated. The locking device is shown in FIG. 8 comprising a first fastening part 190 and a second fastening part 191. The first fastening part is provided for installation in a bore 192 of the handle 111. The housing 112 has a seat 194 provided to carry the second fastening part 191 therein. The second fastening part 191 is aligned in the housing 112 to correspond to the first fastening part 190. The fastening parts 190, 191 can be connected to secure the handle 111 with the housing 112. Preferably, a spring 195 is provided to raise the stud 190 from the connection with the receptacle 191. A bushing or retainer 196 is also provided to facilitate securing the stud to the handle 111 to prevent it from falling out.

The fastening parts can comprise, for example, a quarter-turn fastener, such as a stud member and receptacle, as represented by the elements 190 and 191, respectively. The stud 190 and receptacle 191 can be those which are supplied by Southco, Inc. of Concordville, Pa. Other fastening parts can be employed with the present invention. For example, it is further conceivable that a slam-action type locking arrangement can be achieved, as well as the use of screw or tool shaped configured fasteners. In addition, a key lock or other suitable locking or securing device can also be employed.

It will be apparent to those skilled in the art that various modifications can be made to the handle device invention without departing from the scope and spirit of the invention, and it is intended that the present invention cover modifications and variations of the handle device which are within the scope of the appended claims and their equivalents.

What is claimed is:

1. A handle device for securing a first member to a second member, the handle device comprising:

a) a handle having a gripping portion b) actuation means for actuating said handle device;

c) cam means for camming a pin to said handle; wherein said cam means comprises at least one cam member with mounting means for mounting said cam member for attachment to said first member to which the handle device is to be installed, said cam member including a first wall portion and a second wall portion separated by a connecting wall portion, said first wall portion and said second wall portion each having a generally arcuately shaped slot disposed therein;

d) pawl means for engaging a pawl to secure said handle device wherein said pawl means further comprises a pawl member;

e) connecting means wherein said pawl member is connected to said handle with said connecting means;

f) wherein said pawl member is disposed for movement between said first wall portion and said second wall portion of said cam member;

g) retaining means for retaining said handle device to the said first member;

h) wherein said actuation means is pivotally mounted on said cam means;

i) wherein said cam means is adapted for attachment to said first member with said retaining means and;

j) wherein said pawl means includes means for mounting said pawl member to said handle and means for attachment to said second member.

2. The handle device of claim 1, wherein said connecting means includes a drive pin extending through said arcuately shaped slots of the first and second cam member wall portions for movement along said slots when the device is operated.

3. The handle device of claim 2, further comprising holding means for holding the handle in a vertical position wherein said holding means comprises an indent provided at each end of each said arcuately shaped slot for selectively retaining the drive pin at an end of said slot.

4. The handle device of claim 2, further comprising holding means for selectively holding the handle in one of a vertical position and in a horizontal position.

5. The handle device of claim 4, wherein said holding means comprises a first indent provided at one end of each said arcuately shaped slot and a second indent provided at the other end of each said arcuately shaped slot, and wherein said drive pin is retained by said indent to selectively maintain the handle in one of a horizontal position and a vertical position.

6. The handle device of claim 2, wherein said pawl member includes an engaging wall angularly provided on one side thereof for engagement with the connecting wall of said at least one cam member, and wherein said pawl member includes a slot disposed therein through which the drive pin extends to connect said pawl with said handle, said pawl slot defining a cam surface for positioning said pawl relative to the drive pin.

7. The handle device of claim 6, wherein said drive pin connects the pawl to the handle and extends through said generally arcuate slots provided in said cam member to regulate the movement of the pawl when the handle is moved between a folded horizontal position and an unfolded vertical position.

8. The handle device of claim 1, wherein said handle further includes at least one leg extending outwardly from said gripping portion, said leg having a first end connected to the gripping portion and a second end having a slot disposed therein, said second leg end being pivotally connected to said at least one cam member.

9. The handle device of claim 8, wherein there are at least two cam members, wherein said handle includes a pair of legs extending outwardly from each side of said gripping portion, and wherein each said handle leg member is pivotally connected to a cam member for rotation about an axis, there being a said pawl member connected to each leg member, each said pawl member being pivotally maintained relative to said handle, each said cam member having a vertical slot therein defined in part by the first wall portion, the second wall portion and the connecting wall portion of each cam member, wherein each pawl member is received within the vertical slot of each cam member for vertical movement of the pawl member therein.

10. The handle device of claim 9, further comprising holding means for holding the handle in a horizontal position.

11. The handle device of claim 10, wherein said holding means comprises an indent provided at one end of each said arcuately shaped slot for retaining receipt of the connecting means therein.

12. The handle device of claim 9, wherein said handle is movable from a folded fastening position to an unfolded releasing position, the handle device further comprising a fastener provided on the gripping portion of said handle and a receptacle provided on said first member to which the at least one said cam member is mounted, said receptacle being aligned with said fastener when the handle is in its folded position, wherein said pawl is extended relative to said cam member when said handle is in its unfolded releasing position and is retracted relative to said cam member when said handle is in its folded fastening position.

13. The handle device of claim 1, further comprising retaining means provided on said at least one cam member for retaining said cam member for attachment to said first member.

14. The handle device of claim 1, wherein said handle is movable from a folded fastening position to an unfolded releasing position, the handle device further comprising a lock provided on the gripping portion of said handle and a receptacle provided on said first member to which the at least one said cam member is mounted, said receptacle being aligned with said lock when the handle is in its folded position, wherein said pawl is extended relative to said cam member when said handle is in its unfolded releasing position and is retracted relative to said cam member when said handle is in its folded fastening position.

15. The handle device of claim 1, further comprising holding means for holding the handle in a vertical position.

16. The handle device of claim 1, wherein said handle is movable from a folded fastening position to an unfolded releasing position, the handle device further comprising a fastener provided on the gripping portion of said handle and a receptacle provided on said first member to which the at least one said cam member is mounted, said receptacle being aligned with said fastener when the handle is in its folded position, wherein said pawl is extended relative to said cam member when said handle is in its unfolded releasing position and is retracted relative to said cam member when said handle is in its folded fastening position.

17. A handle device for securing a first member to a second member, the handle device comprising:

a) actuation means for actuating said handle device;

b) a housing with cam means for camming a pin to a handle;

c) pawl means for engaging a bawl to secure said handle device;

d) retaining means for retaining said handle device to a first member;

e) wherein said actuation means is pivotally mounted on said cam means;

f) wherein said cam means is adapted for attachment to said first member with said retaining means;

g) wherein said pawl means includes means for mounting a pawl to a handle and means for attachment to said second member; and h) means for securing said actuation means against movement relative to said housing.

18. The handle device of claim 17, wherein said means for securing said actuation means against movement comprises a fastener having a first fastening part disposed in said actuation means and a second fastening part disposed in said housing.

* * * * *